US006201461B1

(12) United States Patent
Eichendorf et al.

(10) Patent No.: US 6,201,461 B1
(45) Date of Patent: Mar. 13, 2001

(54) ELECTROMAGNETICALLY CONTROLLED VALVE

(75) Inventors: Andreas Eichendorf, Schorndorf; Thomas Sebastian, Stuttgart; Ralf Trutschel, Wolfen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/403,821

(22) PCT Filed: Nov. 26, 1998

(86) PCT No.: PCT/DE98/03476

§ 371 Date: Jan. 12, 2000

§ 102(e) Date: Jan. 12, 2000

(87) PCT Pub. No.: WO99/43948

PCT Pub. Date: Sep. 2, 1999

(30) Foreign Application Priority Data

Feb. 26, 1998 (DE) ..... 198 08 067

(51) Int. Cl.[7] ..... H01F 3/00

(52) U.S. Cl. ..... 335/256; 335/251; 335/255; 335/257; 251/129.15

(58) Field of Search ..... 335/251, 257, 335/255, 256; 251/129.15–129.2; 239/585.1

(56) References Cited

U.S. PATENT DOCUMENTS 5,494,225 * 2/1996 Nally et al. ..... 239/585.5
5,687,468 * 11/1997 Hans et al. ..... 29/602.1
6,042,082 * 3/2000 Graner et al. ..... 251/129.21

FOREIGN PATENT DOCUMENTS 38 31 196 3/1990 (DE) .
195 03 821 8/1996 (DE) .

* cited by examiner

*Primary Examiner*—Lincoln Donovan
*Assistant Examiner*—Tuyen T. Nguyen
(74) *Attorney, Agent, or Firm*—Kenyon & Kenyon

(57) ABSTRACT

An electromagnetically actuable valve, in particular an injection valve for fuel injection systems of internal combustion engines is provided. The actuable valve has a throttling point that joins a core and a connector part to one another. An annular insert that supports the throttling point in a radial direction is provided. The use of the annular insert makes it possible to utilize the advantages of the design of a valve tube with the throttling point, and at the same time creates the stability necessary for high-pressure valves. The annular insert is made from electrically nonconductive material or configured with an interruption at at least one point and mounted in an electrically insulated fashion. This prevents eddy currents, which have a negative effect on switching times, in the annular insert. The annular insert is located at least partially within an influence region of a magnetic field of a magnet coil, in the presence of a changing magnetic field.

9 Claims, 3 Drawing Sheets

ELECTROMAGNETICALLY CONTROLLED VALVE

FIELD OF THE INVENTION

The present invention relates to an electromagnetically actuable valve, in particular a valve for fuel injection systems of internal combustion engines.

BACKGROUND OF THE INVENTION

A fuel injection valve that is electromagnetically actuable, and consequently possesses a magnetic circuit that comprises at least a magnet coil, a core, an armature, and an external pole, is described in German Patent No. 195 03 821.

In the valve described in German Patent No. 195 03 821, the core and a connector part of a valve tube are joined directly to one another via a magnetic throttling point. It is advantageous in this context to configure the entire valve tube integrally, so that it extends over the entire length of the valve. One advantage of the throttling point, which for example is only approximately 0.2 mm thick, lies in the secure sealing of the valve, so that O-rings—which are problematic in terms of leak measurement and valve cleaning—can be dispensed with. In high-pressure valves with maximum pressures in the range, for example, of approximately 10 to 12 MPa (100 to 120 bar), a strength problem however, does occur at the relatively thin-walled throttling point 10.

SUMMARY OF THE INVENTION

The electromagnetically actuable valve according to the present invention has the advantage that it utilizes the advantages—those specific to a magnetic circuit and relating to sealing problems and production engineering—of the design of the valve tube with a thin-walled throttling point, and at the same time eliminates the strength problems of the existing art.

It is particularly advantageous to either produce the annular insert from electrically nonconductive material or configure it with an interruption at at least one point and mount it in electrically insulated fashion. With this feature it is possible to prevent the occurrence of eddy currents in the annular insert, which is located at least partially within the influence region of the magnetic field of the magnet coil, in the presence of a changing magnetic field, since such currents have a negative effect on switching times (energizing and closing times).

A particularly advantageous embodiment of the annular insert consists in configuring it from two concentric rings, which are electrically insulated from one another and each have at least one slot, so that electrically conductive material, for example an austenitic metal having good strength properties and dimensional stability properties, can also be used for the insert. The two rings are preferably arranged in such a way that their slots are positioned with a 180° offset from one another, in order to improve or maintain the mechanical stability of the design.

It is also further advantageous to fill up a gap between the throttling point and the annular insert with an adhesive. This allows larger permissible tolerances for the corresponding diameters of the individual components, as well as more economical manufacture.

DETAILED DESCRIPTION

Figure 1:
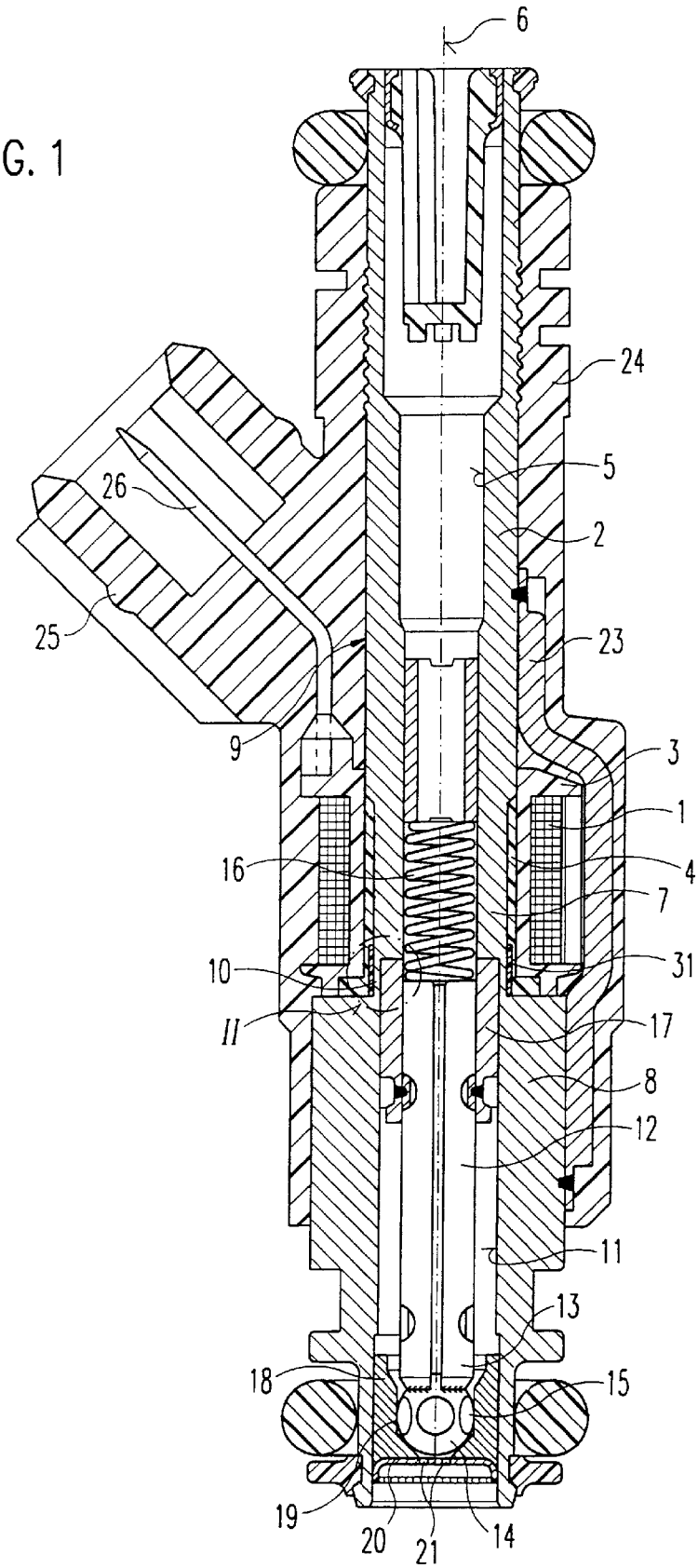
FIG. 1 shows a sectional view of a first embodiment of a fuel injection valve with an annular insert according to the present invention.

The electromagnetically actuable valve depicted in FIG. 1 in exemplary fashion as a first exemplary embodiment, in the form of an injection valve for fuel injection systems of mixture-compressing, spark-ignited internal combustion engines, has a tubular, largely hollow-cylindrical core 2, at least partially surrounded by a magnet coil 1 and serving as the so-called internal pole of a magnetic circuit. A coil body 3 receives a winding of magnet coil 1, and—in combination with core 2 and an annular, nonmagnetic spacer 4 that is partially surrounded by magnet coil 1 and has an L-shaped cross section—makes possible a particularly compact and short configuration of the injection valve in the region of magnet coil 1. Spacer 4 projects with one limb in the axial direction into a step of core 2, and with the other limb radially along an end surface of coil body 3 that is located at the bottom on the drawing.

A continuous longitudinal opening 5 that extends along a longitudinal valve axis 6 is provided in core 2. An additional thin-walled tubular sleeve (not shown in FIG. 1), which projects through the inner longitudinal opening 5 of core 2 and rests directly against the wall of longitudinal opening 5, can advantageously extend concentrically with longitudinal valve axis 6. This sleeve possesses a sealing function with respect to core 2, by the fact that in the direction of longitudinal valve axis 6 or in the downstream direction, it forms an encapsulation of core 2 and thereby prevents fuel from making contact with core 2.

Core 2 is not, as in the case of conventional injection valves, embodied as a component that actually terminates at a lower core end 7; instead it continues further in the downstream direction, so that a tubular connector part arranged downstream from coil body, referred to hereinafter as connector part 8, is configured integrally with core 2 as a so-called external pole, the entire component being referred to as valve tube 9. At the transition from core 2 to connector part 8, valve tube 9 possesses a magnetic throttling point 10, also tubular but having a much thinner wall than the wall thicknesses of core 2 and connector part 8. This magnetic throttling point 10 proceeds out from lower core end 7 concentrically with longitudinal valve axis 6 of core 2 and connector part 8.

Instead of the integral configuration of valve tube 9, throttling point 10 can also be configured integrally only with either lower core end 7 or connector part 8.

A longitudinal bore 11 that is configured concentrically with longitudinal valve axis 6 extends in connector part 8. Arranged in longitudinal bore 11 is a, for example, tubular valve needle 12 that is joined at its downstream end 13, for example by welding, to a spherical valve closure element 14 on whose periphery are provided several flattened areas 15 past which fuel can flow.

The electromagnetic circuit having magnet coil 1, core 2, and an armature 17 serves to move valve needle 12 axially, and thus to open the injection valve against the spring force of a return spring 16, and to close the injection valve. Armature 17 is joined to the end of valve needle 12 facing away from valve closure element 14 by a welded seam, and is aligned on core 2. A cylindrical valve seat element 18, which has a fixed valve seat, is mounted in longitudinal bore 11 in a sealed fashion, for example by welding, into the end of connector part 8 located downstream and facing away from core 2.

A guide opening 19 in valve seat element 18 serves to guide valve closure element 14 during the axial movement of valve needle 12 with armature 17 along longitudinal valve axis 6. The spherical valve closure element 14 coacts with the valve seat of valve seat element 18, said seat tapering in truncated conical form in the flow direction. At its end face facing away from valve closure element 14, valve seat element 18 is immovably joined to a perforated spray disk 20 configured, for example, in a cup shape. Cup-shaped perforated spray disk 20 possesses at least one spray discharge opening 21, shaped e.g. by electrodischarge machining or punching. In other conventional embodiments of injection valves, nonmagnetic spacing elements, which are provided instead of throttling point 10 and ensure magnetic separation of core 2 and connector part 8, are used for exact guidance of armature 17, joined to valve needle 12, during the axial movement. These nonmagnetic spacing elements are manufactured precisely and with high accuracy, for example on precision lathes, in order to achieve a small guidance clearance. Since the injection valve shown in FIG. 1, because of the integral design of valve tube 9, now does not require any such spacing element, it is advisable to provide on the outer periphery of armature 17 at least one guide surface 22 (FIG. 2) that is manufactured e.g. by lathe-turning. The at least one guide surface 22 can be configured, for example, as a continuously peripheral guide ring or as several guide surfaces configured on the periphery at a distance from one another.

The insertion depth of valve seat element 18 with cup-shaped perforated spray disk 20 determines the magnitude of the linear stroke of valve needle 12. The one end position of valve needle 12, when magnet coil 1 is not energized, is defined by contact of valve closure element 14 against the valve seat of valve seat element 18, while the other end position of valve needle 12, when magnet coil 1 is energized, results from contact of armature 17 against lower core end 7.

The arrangement shown in FIG. 1 of connector part 8 with valve seat 18, and of the movable valve part made up of armature 17, valve needle 12, and valve closure element 14, represents only one possible embodiment of the valve assembly that succeeds the magnetic circuit in the downstream direction. This valve region 15 omitted in the following Figures; it is emphasized that a wide variety of valve assemblies can be combined with the design according to the present invention of the injection valve in the region of throttling point 10. In addition to the spherical valve closure element 14 described above, and the use of perforated spray disks 20, injection valves that open outward are also conceivable.

Magnet coil 1 is surrounded by at least one conductive element 23, configured for example as a bracket and serving as a ferromagnetic element, that at least partially surrounds magnet coil 1 in the circumferential direction and rests with its one end against core 2 and its other end against connector part 8, and can be joined to them, for example, by welding, soldering, or adhesive bonding.

The injection valve is largely enclosed by an injection-molded plastic sheath 24 that extends, proceeding from core 2, axially over magnet coil 1 and the at least one conductive element 23 to connector part 8, the at least one conductive element 23 is completely covered axially and in the circumferential direction. Also part of this injection-molded plastic sheath is an electrical connector plug 25, for example co-molded on, in which contact elements 26 for electrical contacting to magnet coil 1 are also provided.

Figure 2:
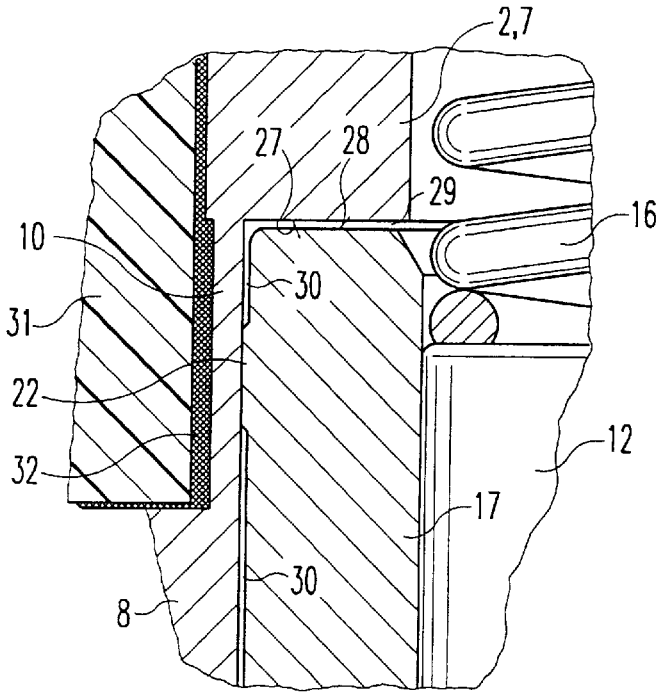
FIG. 2 shows an enlarged view of portion II of FIG. 1 in the region of the throttling point.

FIG. 2 depicts, at enlarged scale, portion II of the injection valve shown in FIG. 1 in the region of magnetic throttling point 10. Lower core end 7 of core 2 has a downstream end surface 27 that serves as stop surface for armature 17 with its upstream end surface 28. When the valve is closed, i.e. when valve closure element 14 is in contact against the valve seat of valve seat element 18, an air gap 29 is present between the two end surfaces 27 and 28. Reducing the leakage flux bypassing the air gap usually will improve a magnetic circuit.

Valve tube 9 used in the present exemplary embodiment is thus, as described above, of integral configuration, and possesses a direct magnetically conductive connection between core 2 and connector part 8 via magnetic throttling point 10. In order nevertheless to minimize the leakage flux bypassing air gap 29, magnetic throttling point 10 is configured with a very thin wall thickness. Magnetic throttling point 10, for example 2 mm long in the axial direction, has a wall thickness of, for example, only 0.2 mm. This represents an approximate minimum limit value that still guarantees sufficient stability for valve tube 9 at the low maximum pressures that are common in gasoline injection valves for manifold injection. Upon energization of magnet coil 1, the magnetic flux in the magnetic circuit thus also passes directly through the very narrow magnetic throttling point 10. Saturation flux density is thereby achieved very quickly, i.e. in only a fraction of the actual switching time of the valve. Magnetic throttling point 10, which is saturated and exhibits a permeability of about 1, therefore functions as a throttling point.

The at least one guide surface 22 shaped onto armature 17, which extends radially outward over the actual outside diameter of the armature, results in a radial air gap 30 outside guide surface 22 between magnetic throttling point 10, and connector part 8 and armature 17. This radial air gap 30 should be as narrow as possible, since the magnetic flux enters armature 17 radially via the air. With this arrangement, the total magnetic flux in the injection valve increases, by comparison with injection valves having a nonmagnetic spacer element, by an amount equivalent to the magnetic flux through throttling point 10. The other conductive cross sections of core 2 and conductive element 23 are adapted accordingly or minimally enlarged.

The integral design of valve tube 9 as described above can result in more economical manufacture and more secure sealing of the injection valve, with no reduction in the quality of the magnetic circuit as compared to designs having a nonmagnetic spacer element. In order to be able to utilize these advantages for high-pressure valves having maximum pressures in the range from approximately 10 to 12 MPa (100 to 120 bar), the load-carrying capacity of throttling point 10 must be increased accordingly. Configuring the throttling point with a greater wall thickness is not an option, since this would have a negative effect on the magnetic circuit.

The solution to this problem is now described below with reference to portion II of FIG. 1 shown in FIG. 2, which shows the region of throttling point 10 at enlarged scale. The design of the valve according to the present invention contains, as a further component, an annular insert 31 that is arranged radially on the exterior of throttling point 10, and extends axially along the entire throttling point 10 and partially along lower core end 7.

Insert 31 is inserted into a corresponding recess of spacer 4, and is immovably joined to throttling point 10 and lower core end 7 via a joining film 32. An adhesive film is preferably used as joining film 32, since it not only constitutes an electrical insulator but also can compensate for irregularities in the gap between insert 31, and throttling point 10 and core end 7.

In accordance with a first alternative according to the present invention, annular insert 31 is not just a metal ring, which would exhibit good stability and strength properties but on the other hand would result in the creation of eddy currents in the presence of a changing magnetic field; these would have a negative effect on the switching times (energizing and closing times) of the valve, since metal ring 31 necessarily lies at least partially inside the influence region of the magnetic field of magnet coil 1. Configuring insert 31 as a continuous metal ring thus results in a delayed magnetic force buildup upon energization, and a delayed magnetic force decrease upon deactivation. For this reason, insert 31 should be configured from an electrically nonconductive material or as an insert 31 that is interrupted at at least one point and is mounted in electrically insulated fashion. A material suitable for an integral insert 31 is, for example, a plastic material that is optionally reinforced with carbon fibers or the like, or also a ceramic material.

Figure 4:
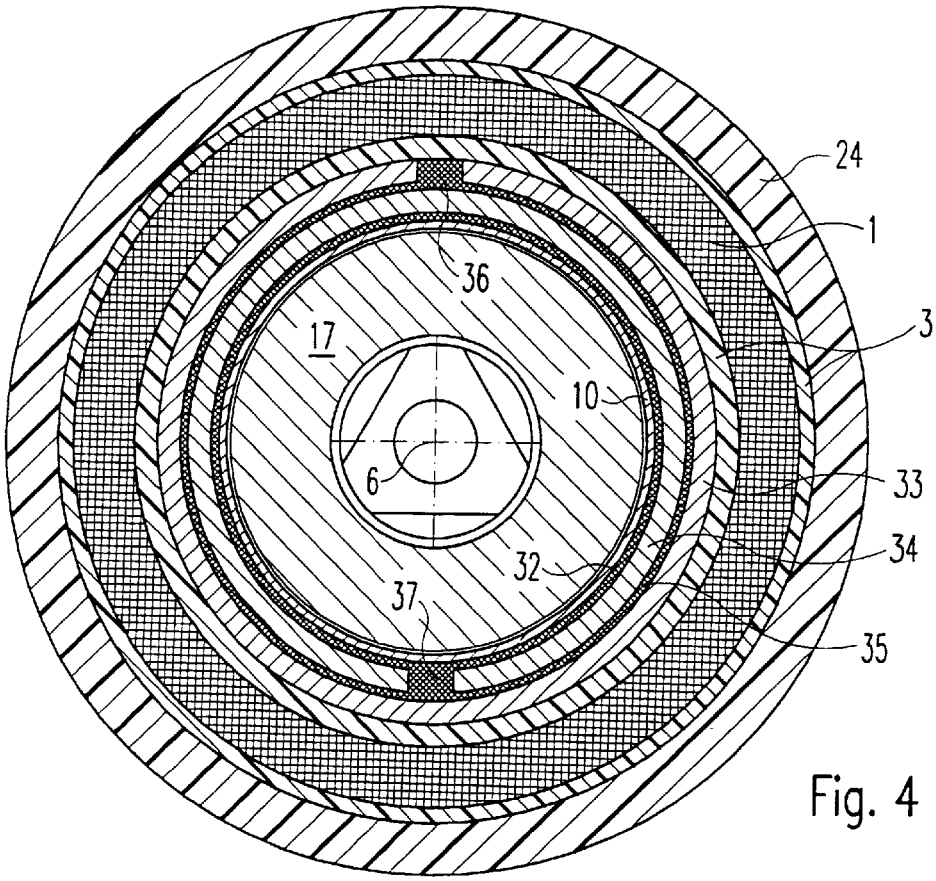
FIG. 4 shows a section of the injection valve along line IV—IV of FIG. 3.
Figure 3:
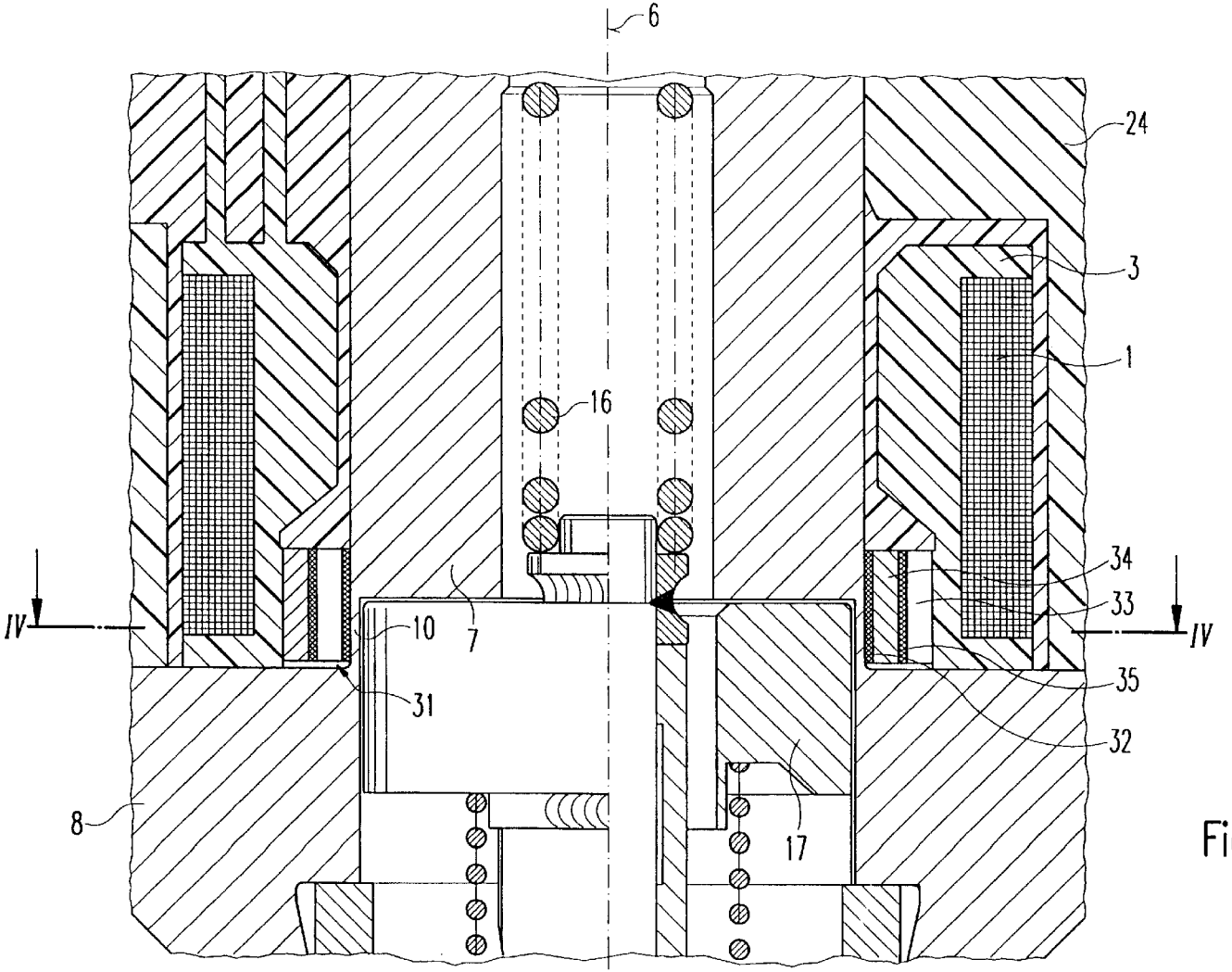
FIG. 3 shows a sectional view of a second embodiment of an injection valve according to the present invention.

A preferred embodiment of annular insert 31 is depicted in FIGS. 3 and 4. In this exemplary embodiment, insert 31 comprises two concentric metal rings 33 and 34 that are electrically insulated from one another by an adhesive film 35 and each have a slot 36, 37. As a result, a continuous electrically conductive circuit is not present in insert 31, and therefore no eddy currents can form in insert 31 in the presence of a changing magnetic field. In order to maximize the stability of insert 31, the two metal rings 33 and 34 are arranged in such a way that their slots 36 and 37 are offset 180° from one another, as is evident from FIG. 4. Austenitic metal is preferably used for the two metal rings 33, 34.

For manufacturing, first the two metal rings 33 and 34 are adhesively bonded to one another before assembly. Then the complete insert 31 is adhesively bonded to throttling point 10. Adhesion is advantageously performed in two steps, so that the two metal rings 33 and 34 also provide axial support.

Attaching annular insert 31 to throttling point 10 using adhesive 32 also allows greater permissible tolerances and irregularities for the corresponding diameters of throttling point 10 and insert 31. At the same time, this allows more economical production of the injection valve.

The design according to the present invention has two essential advantages. On the one hand, the use of an integral or at least continuous valve tube 9 creates an injection valve with secure sealing; and on the other hand, the insertion of annular insert 31, which increases the stability of the arrangement, makes the design additionally usable, in particular, for high-pressure valves injecting directly into the combustion chamber of an internal combustion engine.

As demonstrated by simulation calculations, the specific selection of materials for metal rings 33, 34 and adhesive 32, 35 is not problematic, i.e. a plurality of materials can be used.

What is claimed is:

1. An electromagnetically actuable fuel injection valve for a fuel injection system of an internal combustion engine, comprising:

a magnet coil;

a core at least partially surrounded by the magnet coil, the core having an internal longitudinal opening;

an armature;

a valve closure element actuable by the armature, the valve closure element coacting with a fixed valve seat;

a tubular connector part arranged downstream from the core, the tubular connector part radially surrounding the armature;

a magnetic throttling point joining the core and the tubular connector part to each other, the magnetic throttling point being formed in one piece with at least one of the core and the tubular connector part; and an annular insert supporting the magnetic throttling point the annular insert at least partially radially surrounding the magnetic throttling point.

2. The valve according to claim 1, wherein the annular insert is composed of an electrically nonconductive material, the electrically nonconductive material including plastic.

3. The valve according to claim 1, wherein the annular insert is discontinuous at least one point and mounted in an electrically insulated fashion.

4. An electromagnetically actuable fuel injection valve for a fuel injection system of an internal combustion engine, comprising:

a magnet coil;

a core at least partially surrounded by the magnet coil, the core having an internal longitudinal opening;

an armature;

a valve closure element actuable bv the armature, the valve closure element coacting with a fixed valve seat;

a tubular connector part arranged downstream from the core, the tubular connector part at least partially radially surrounding the armature; and a magnetic throttling point joining the core and the tubular connector part to each other; and an annular insert supporting the magnetic throttling point, the annular insert being discontinuous at at least one point and mounted in an electrically insulated fashion, the annular insert including two concentric rings, the two concentric rings being electrically insulated from one another, each of the two concentric rings having at least one slot.

5. The valve according to claim 4, wherein the at least one slot of each of the two concentric rings are arranged offset 180° from one another.

6. The valve according to claim 4, wherein the two concentric rings are electrically insulated from one another by an adhesive film.

7. The valve according to claim 4, wherein the two concentric rings are made of austenitic metal.

8. The fuel injection valve according to claim 3, further comprising;

an adhesive film filling a gap between the throttling point and the insert.

9. The valve according to claim 1, wherein the magnetic throttling point is formed in one piece both the core and the tubular connector part.

* * * * *